US005656407A

United States Patent [19]

Kawahara

[11] Patent Number: 5,656,407

[45] Date of Patent: Aug. 12, 1997

[54] PHOTOSENSITIVE MATERIAL FOR ELECTROPHOTOGRAPHY

[75] Inventor: Akihiko Kawahara, Osaka, Japan

[73] Assignee: Mita Industrial Co., Ltd., Osaka, Japan

[21] Appl. No.: 266,503

[22] Filed: Jun. 27, 1994

[30] Foreign Application Priority Data

| | | | |
|---|---|---|---|
| Jun. 29, 1993 | [JP] | Japan | 5-159700 |
| Mar. 23, 1994 | [JP] | Japan | 6-051522 |

[51] Int. Cl.[6] ..... G03G 5/09

[52] U.S. Cl. ..... 430/78; 430/56; 430/83; 430/91; 430/95; 430/133; 430/134

[58] Field of Search ..... 430/83, 78, 133, 430/134, 59, 56, 91, 95

[56] References Cited

U.S. PATENT DOCUMENTS

| | | | |
|---|---|---|---|
| 3,992,205 | 11/1976 | Wiedemann . | |
| 4,855,202 | 8/1989 | Yoshihara et al. | 430/59 |
| 4,877,702 | 10/1989 | Miyamoto et al. | 430/72 |
| 4,882,254 | 11/1989 | Loutfy et al. | 430/83 |
| 4,983,483 | 1/1991 | Tsai | 430/59 |
| 5,063,126 | 11/1991 | Nakatani et al. | 430/59 |
| 5,153,088 | 10/1992 | Muto et al. | 430/78 |

FOREIGN PATENT DOCUMENTS

| | | | |
|---|---|---|---|
| 0385440 | 9/1990 | European Pat. Off. . | |
| 0470729 | 2/1992 | European Pat. Off. . | |
| 0491316 | 6/1992 | European Pat. Off. . | |
| 2249367 | 5/1975 | France . | |
| 59-116753 | 7/1984 | Japan | 430/78 |
| 63-18353 | 1/1988 | Japan | 430/78 |
| 5-232724 | 9/1993 | Japan | 430/78 |
| 5-333575 | 12/1993 | Japan . | |
| 2231166 | 11/1990 | United Kingdom . | |

OTHER PUBLICATIONS

Patent & Trademark English Language Translation of JP 5–333575 (Pub Dec. 1993).

Database WPI, Derwent Publications Ltd., London, GB, AN–128841(04). of Japanese Patent 05–333575 (Pub Dec. 17, 1993).

*Primary Examiner*—Janis L. Dote

*Attorney, Agent, or Firm*—Sherman and Shalloway

[57] ABSTRACT

A photosensitive material for electrophotography, wherein the charge-generating agent comprises a P-type charge-generating pigment and an N-type charge-generating pigment in combination, at least part of these pigments being present in the form of aggregates in the photosensitive layer. The photosensitive material will assume the form of either a single dispersion type or a laminated layer type, and exhibits very high carrier generation efficiency, strikingly improved sensitivity on the side of long wavelengths, excellent balance in the spectral sensitivity and property after repetitively used, and can hence be effectively used for forming image by the electrophotography.

4 Claims, 2 Drawing Sheets

PHOTOSENSITIVE MATERIAL FOR ELECTROPHOTOGRAPHY

BACKGROUND OF THE INVENTION

1. Field of the Invention

The present invention relates to a photosensitive material for electrophotography and, more specifically, to a sensitized photosensitive material for electrophotography.

2. Description of the Prior Art

Widely used photosensitive materials for electrophotography can be represented by those of the function separated-type that are obtained by providing on an electrically conducting substrate a photosensitive layer which contains a charge-generating agent and a charge-transporting agent. The photosensitive materials of this type can roughly be divided into those of the type of a so-called single dispersion layer obtained by dispersing a charge-generating agent in a medium that contains a charge-transporting agent and those of the type of a so-called laminated layer obtained by providing on the electrically conducting substrate, the charge-generating agent and the charge-transporting layer in the order mentioned or in a reverse order.

As the charge-generating agent, there are used, in many cases, P-type charge-generating pigments such as phthalocyanine pigment and like pigment as well as N-type charge-generating pigments such as perylene pigment, azo pigment and like pigment. Generally, however, these pigments have poor balance in the spectral sensitivity. When use is made only of the N-type charge-generating pigment such as perylene pigment or azo pigment, in particular, sensitivity is low on the side of long wavelengths of from 600 to 700 nm and fogging occurs on a yellow-base paper. In designing a photosensitive material that can be used in common for the halogen source of light, fluorescent source of light and laser source of light, it is desired that the photosensitive material has panchromatic spectral sensitivity. There is, however, available no pigment that meets the above requirement, and technology has been proposed for using plural kinds of pigments as described below.

Japanese Laid-Open Patent Publication No. 222961/1990 filed by the present applicant discloses a photosensitive material of the laminated layer type in which a charge-transporting layer and a charge-generating layer are provided on an electrically conducting substrate in the order mentioned, by using, as charge-generating agents, an N-type pigment (dibromoanthanthrone) and a P-type pigment (metal-free phthalocyanine) at a ratio of from 40/80 to 90/10.

Moreover, Japanese Laid-Open Patent Publication No. 228670/1990 discloses the use of an X-type metal-free phthalocyanine in an amount of from 1.25 to 3.75 parts by weight in combination per 100 parts by weight of a perylene pigment.

In the case of the former proposal (Japanese Laid-Open Patent Publication No. 222961/1990) using the N-type pigment and the P-type pigment in combination, when the photosensitive material is positively charged by the corona discharge, an electric field established by the corona discharge acts upon the P-type pigment that is electrically in a neutral state, whereby thermal holes are injected into the charge-transporting layer from the P-type pigment to neutralize the negative electric charge induced on the side of the substrate. Besides, negative space charge exists in the charge-generating layer which is the outermost layer, and intensifies the electric field together with the positive charge on the surface of the photosensitive material to enhance the photocarrier generation efficiency. However, this effect is obtained only when the charge-transporting layer and the charge-generating layer are provided in this order on the electrically conducting substrate, which is not still satisfactory from the standpoint of improving the photocarrier generation efficiency. According to the above latter proposal (Japanese Laid-Open Patent Publication No. 228670/1990) which uses the N-type pigment and the P-type pigment in combination, the sensitivity to red light is improved to some extent. However, this photosensitive material in which the N-type pigment (X-type metal-free phthalocyanine) is added to the P-type pigment (perylene pigment) which is a main pigment, so that these pigments are simply dispersed together in a binder resin, is not still satisfactory from the standpoint of improving the photocarrier generation efficiency and is not still satisfactory, either, for being used in such applications as in a high-speed laser printer and the like.

SUMMARY OF THE INVENTION

The present inventors have attempted to use a P-type charge-generating agent and an N-type charge-generating agent or an N-type inorganic semiconductor or photoconductor as a charge-generating agent, at least part of the charge-generating agent being contained in the form of aggregates in the photosensitive layer, and have obtained markedly improved carrier generation efficiency as compared with when the P-type charge-generating agent and the N-type charge-generating agent are simply dispersed together. In this case, the present inventors have further discovered the facts that the sensitivity is strikingly improved on side of long wavelengths, the photosensitive layer exhibits excellent balance in the spectral sensitivity and that the photosensitive layer exhibits improved abrasion resistance.

That is, the object of the present invention is to provide a photosensitive material for electrophotography containing a charge-generating agent and a charge-transporting agent, which exhibits markedly improved carrier generation efficiency, strikingly improved sensitivity on the side of long wavelengths, excellent balance in the spectral sensitivity and excellent properties even after used repetitively.

According to the present invention, there is provided a photosensitive material for electrophotography having an electrically conducting substrate and a photosensitive layer containing a charge-generating agent and a charge-transporting agent, wherein said charge-generating agent comprises a P-type charge-generating pigment and an N-type charge-generating pigment or an N-type inorganic semiconductor or photoconductor, and at least part of said charge-generating agent is dispersed in the form of aggregates in the photosensitive, layer.

The aggregates of the charge-generating agent present in the photosensitive layer of the present invention have aggregated structure in which a plural number of grains of the P-type charge-generating pigment (hereinafter often called P-type charge-generating grains) or a plural number of grains of the N-type charge-generating pigment or the N-type inorganic semiconductor or photoconductor (hereinafter often called N-type charge-generating grains) are aggregated together via the N-type charge-generating grains or the P-type charge-generating grains. The aggregates should generally have a grain size of from 0.2 to 2 μm.

Presence of aggregates and aggregated structure in the photosensitive layer of the present invention can be confirmed relying both upon a transmission-type electron microphotography and an energy dispersion-type X-ray spectral method. In this specification, the grain size is defined as a one-half value of the sum of a long diameter of a grain and a short diameter of a grain.

DETAILED DESCRIPTION OF THE INVENTION

Figure 1:
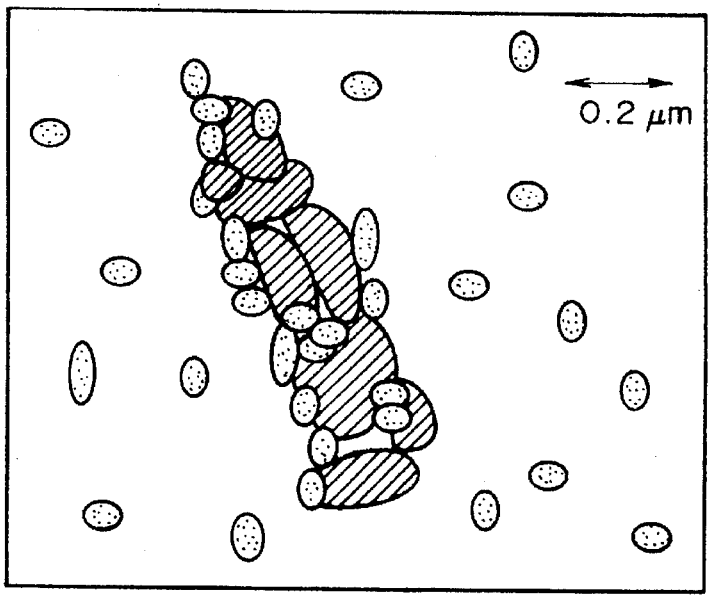
FIG. 1 is a sketch from a transmission-type electron microphotography of a photosensitive layer of the present invention.
Figure 2:
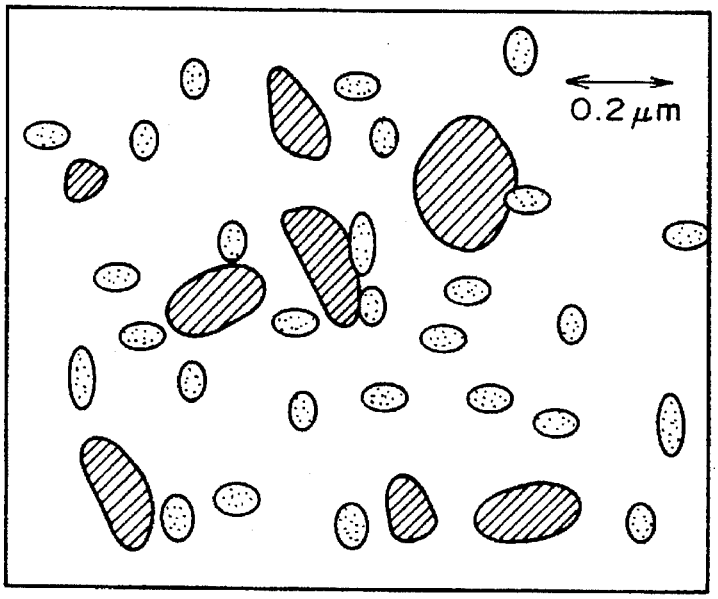
FIG. 2 PRIOR ART
FIG. 2 is a sketch from a transmission-type electron microphotography of a conventional photosensitive layer of the type in which the agents are dispersed together.

In the accompanying drawings, FIG. 1 is a sketch from a transmission-type electron microphotography of a photosensitive layer of the present invention and FIG. 2 is a sketch from the transmission-type electron microphotography of a conventional photosensitive layer in which the agents are dispersed together. In these drawings, hatched grains are P-type charge-generating grains, and dotted grains are N-type charge-generating grains.

It will be obvious from these drawings that in the conventional photosensitive layer, the P-type charge-generating pigment and the N-type charge-generating pigment are dispersed in the form of individual grains in a resin medium (continuous phase) whereas in the photosensitive layer of the present invention, the P-type charge-generating grains and the N-type charge-generating grains are aggregated constituting an aggregated structure in which a plural number of the P-type (N-type) charge-generating grains are aggregated together via N-type (P-type) charge-generating grains, and in which aggregates of the grains are growing. In a concrete example shown in FIG. 1, furthermore, it will be understood that part of the N-type charge-generating grains contained in a large amount exist in the form of a dispersion of individual grains in addition to being aggregated but the P-type charge-generating grains which are contained in a small amount exist mostly in the form of aggregates.

According to the present invention as described above, the P-type charge-generating grains and the N-type charge-generating grains at least partly assume the form of aggregates exhibiting markedly improved carrier generation efficiency and giving advantages in regard to increased sensitivity on the side of long wavelengths, improved balance in the spectral sensitivity of the photosensitive layer, and enhanced durability of the photosensitive layer.

Reference should be made to Examples appearing later. When, for example, an N-type charge-generating pigment (perylene) is used alone (Comparative Example 1), fairly good sensitivity is obtained on the side of relatively short wavelengths (500 nm) but almost no sensitivity is obtained on the side of long wavelengths (700 nm). When a P-type charge-generating pigment (phthalocyanine) is used alone (Comparative Examples 2 and 3), on the other hand, fairly good sensitivity is obtained on the side of relatively long wavelengths but almost no sensitivity is obtained on the side of relatively short wavelengths, both of which give poor balance in the spectral sensitivity.

By giving attention to the sensitivity, furthermore, even when the P-type charge-generating grains and the N-type charge-generating grains are used in combination, the system in which these grains are individually dispersed together (Comparative Example 4) gives a result which is nothing but the combination of the result of when the N-type charge-generating grains (perylene) were used alone (Comparative Example 1) and the result of when the P-type charge-generating grains (phthalocyanine) were used alone (Comparative Example 2). Thus, no improvement is recognized in the carrier generation efficiency, and the sensitivity becomes poor particularly on the side of long wavelengths and the surface potentials (both the initial potential and the residual potential after exposure to light) vary greatly after being used repetitively.

On the other hand, when aggregates of the P-type charge-generating grains and the N-type charge-generating grains are formed in advance according to the present invention and are made present in the photosensitive layer (Example 1), the photosensitive layer exhibits improved balance in the spectral sensitivity at every wavelength and exhibits markedly improved sensitivity on the side of long wavelengths despite the P-type charge-generating grains and the N-type charge-generating grains are blended in the photosensitive layer at the same ratio as that of Comparative Example 4. This is considered to stem from an increased carrier generation efficiency. Moreover, the surface potentials vary within suppressed small ranges even after being used repetitively.

Moreover, the sensitivity (700 nm) of nearly an equal level is obtained when the P-type charge-generating grains (phthalocyanine) and the N-type charge-generating grains (perylene) are used in combination at a ratio of 3 parts by weight and 10 parts by weight to form aggregates in advance, which are then made present in the photosensitive layer (Example 5) and when the P-type charge-generating grains (phthalocyanine) are used alone in an amount of 10 parts by weight (Comparative Example 3). This is because in Example 5 where the aggregates are formed, the N-type charge-generating grains that are added in an amount of even 3 parts by weight help improve the carrier generation efficiency owing to microscopic P-N junctions, making it possible to exhibit the effect comparable to that of when the N-type charge-generating grains (phthalocyanine) are used alone in an amount of 10 parts by weight.

By using the structure in which the agents are dispersed together, furthermore, the sensitivity (500 nm and 700 nm) comparable to that of the structure in which aggregates are present in the photosensitive layer is obtained only by increasing the amount of the P-type charge-generating grains (Comparative Example 8). In this case, however, surface potentials (initial potential and residual potential after exposure to light) vary greatly after being used repetitively.

The above-mentioned improvement in the photosensitive layer of the present invention was found as phenomenon by the present inventors through extensive study. According to the present inventors, the improvement is obtained presumably because of the following reasons.

In the photosensitive layer of the present invention, the P-type charge-generating grains or the N-type charge-generating grains establish aggregated structure in which they are aggregated via grains of the opposite polarity, and in the aggregated grains are formed numerous P-N Junctions on the interfaces among the primary grains. In the photosensitive layer of the present invention, it is believed that the carrier generation efficiency is improved in a broad wavelength zone inclusive of the long wavelength region owing to the formation of PN junctions, contributing to increasing the sensitivity.

Furthermore, the photosensitive material of the present invention can be electrically charged into either polarity, and electrostatic latent image can be formed on the surface of the photosensitive layer either when it is positively charged or negatively charged. This is presumably because the sensitivity is obtained with either polarity owing to electron-transporting property of the N-type charge-generating grains and hole-transporting property of the P-type charge-generating grains.

When the N-type inorganic semiconductor or photoconductor is used as the N-type charge-generating grains in accordance with the present invention, furthermore, the aforementioned aggregated structure is formed and, besides, the grains exhibit a large hardness presenting another advantage in that the photosensitive layer as a whole is effectively prevented from being worn out.

Photosensitive Material

In the photosensitive material of the present invention, the photosensitive layer may contain the charge-generating agent and the charge-transporting agent either in the form of laminated layers or a single layer dispersion.

Here, however, the single layer dispersion helps most distinctly exhibit the effect for forming microscopic P-N junctions on the interfaces among the primary grains since the pigment concentration is low in the layer.

Figure 3:
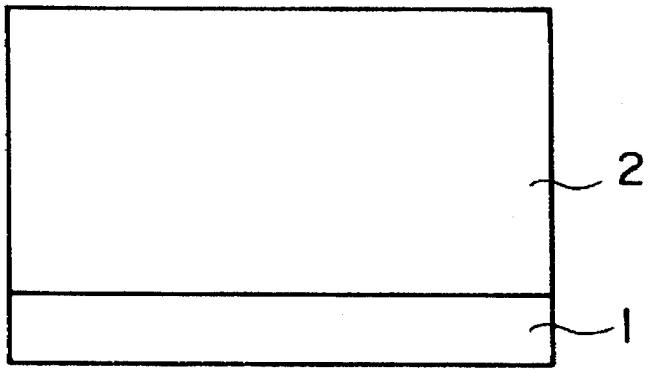
FIG. 3 is a sectional view of a photosensitive material of the type of single dispersion layer for electrophotography.

With reference to FIG. 3, the photosensitive material for electrophotography comprises an electrically conducting substrate 1 on which a single photosensitive layer 2 is provided containing the charge-generating agent and the charge-transporting agent therein. The layer 2 of generating and transporting the electric charge comprises a composition of a continuous phase which contains the charge-transporting agent (CTM) and a dispersion phase of a particular charge-generating agent (CGM) that is dispersed in the continuous phase as will be described later in detail.

Figure 4:
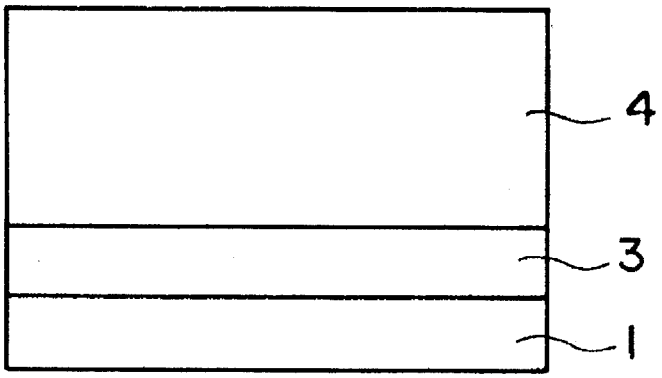
FIG. 4 is a sectional view of a photosensitive material of the laminated layer type for electrophotography.

With reference to FIG. 4, another photosensitive material for electrophotography comprises an electrically conducting substrate 1 on which are provided a charge-generating layer (CGL) 3 containing a particular charge-generating agent that will be described below in detail and a charge-transporting layer (CTL) 4 in the order mentioned.

Figure 5:
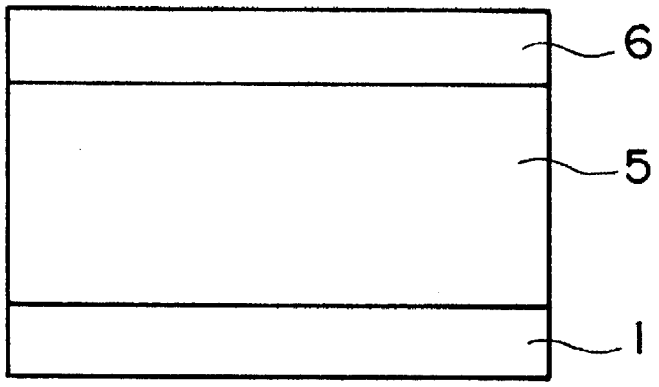
FIG. 5 is a sectional view of another photosensitive material of the laminated layer type for electrophotography.

With reference to FIG. 5, a further photosensitive material for electrophotography comprises an electrically conducting substrate 1 on which are provided a charge-transporting layer (CTL) 5 and a charge-generating layer (CGL) 6 containing a particular charge-generating agent that will be mentioned below in detail in the order mentioned.

In these photosensitive materials, the photosensitive layer 2, the charge-transporting layer 4 or the charge-transporting agent (CTM) in the layer 5 may comprise a positive hole-transporting agent, an electron-transporting agent, or a combination thereof.

Though not diagramed in FIGS. 3 to 5, the photosensitive material of the present invention may be provided, as an uppermost layer, with a protection layer that has been known per se, such as the one which contains, for example, a charge-transporting agent/or the electrically conducting fine powder.

Charge-Generating Agent

According to the present invention, the P-type charge-generating grains and the N-type charge-generating grains are used in combination as a charge-generating agent, and at least part of them are made present in the form of aggregates in the photosensitive layer.

Each aggregate comprises a plurality of the P-type (or the N-type) charge-generating grains which are aggregated together via the N-type (or the P-type) charge-generating grains of the contrasting polarity, and numerous P-N junctions exist in the aggregates.

As the P-type charge-generating grains constituting the aggregates of the present invention, there can be used a known P-type charge-generating pigment such as phthalocyanine pigment, naphthalocyanine pigment and other porphyrin pigments.

The porphyrin pigments have a skeleton represented by the following formula (1),

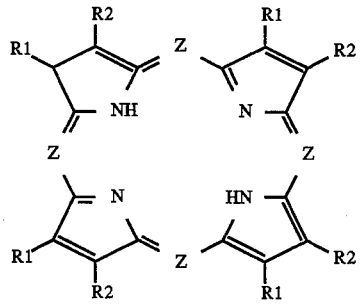

(1)

wherein Z is a nitrogen atom or a CH group, R1 and R2 are substituted or unsubstituted monovalent hydrocarbon groups having not more than 12 carbon atoms, and R1 and R2 being coupled together may form a substituted or unsubstituted benzene ring or naphthalene ring together with carbon atoms bonded thereto.

Particularly preferred examples include:

X-type metal-free phthalocyanine, oxotitanyl phthalocyanine, and metal-free naphthalocyanine.

It is desired that the P-type charge-generating pigment usually has a grain size of from 0.1 to 1 μm.

As the N-type charge-generating grains that constitute aggregates, there can be used a known N-type charge-generating pigment such as perylene pigment, azo pigment, squarylium pigment or polycyclic quinone pigment. There can be further used an N-type semiconductor or photoconductor in addition to the above.

The perylene pigment will have the following formula (2),

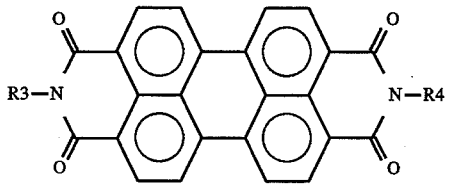

(2)

wherein R3 and R4 are each a substituted or unsubstituted alkyl group with not more than 18 carbon atoms, a cycloalkyl group, an aryl group, or an aralkyl group, and the substituent may be an alkoxy group, a halogen atom or the like.

As the azo pigment, any charge-generating pigment that has heretofore been used can be used such as monoazo pigment, disazo pigment or trisazo pigment.

The squarylium pigment will have the following formula

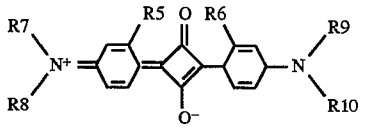

(3)

wherein R5 and R6 are each an alkyl group, an alkoxy group, or a halogen atom, R7, R8, R9 and R10 are each an alkyl group, a cycloalkyl group, an alkoxy group, a halogen atom, an aryl group, or an aralkyl group, and each of the groups may have an alkyl group, an alkoxy group or a halogen atom as a substituent.

As the polycyclic quinone pigment, there can be used anthanthrone pigment, quinacridone pigment, perynone pigment, quinophthalone pigment, flavanthrone pigment, pyranthrone pigment, violanthrone pigment, anthrone pigment or indanthrone pigment.

It is desired that the above-mentioned N-type charge-generating pigment usually has a primary grain size of from 0.1 to 1 μm. The P-type charge-generating pigment and the N-type charge-generating pigment should be used in amounts providing a weight of from 10:0.1 to 0.1:10 and, particularly, from 10:0.5 to 0.5:10.

As the N-type inorganic semiconductor or photoconductor, there is usually used a semiconductor or a photoconductor of the type of an inorganic oxide. Preferred examples include, titanium oxide ($TiO_2$), tin oxide ($SnO_2$), indium-doped tin oxide (ITO), antimony-doped tin oxide and zinc oxide (ZnO).

The inorganic semiconductor or photoconductor should usually be in a fine particular form having a primary grain size of from 0.01 to 5 μm and, particularly, from 0.1 to 1 μm.

From the standpoint of sensitivity, there exists an optimum range in the ratio of blending the P-type organic charge-generating pigment (A) and the N-type inorganic semiconductor or photoconductor (B). In general, the weight ratio A:B should be from 10:1 to 1:40 and, particularly, from 2:1 to 8:40. When the ratio of the inorganic semiconductor or photoconductor is greater than the above range, the charging property of the photosensitive layer tends to decrease. When the ratio thereof is smaller than the above range, on the other hand, the sensitivity is not much improved and the abrasion resistance is not sufficiently improved, either.

Formation of Aggregates

According to the present invention, aggregates of the P-type charge-generating grains and the N-type charge-generating grains are not formed by simply dispersing them together in a resin solution, and a pretreatment must be carried out.

The pretreatment can be by either a wet method or a dry method. In the wet method, the P-type charge-generating grains and the N-type charge-generating grains are dispersed in a finely pulverized form in a particular polar solvent such as a tetrahydrofuran or a dichloromethane to form aggregates thereof.

In these solvents, the two grains are finely pulverized and are dispersed, so that the P-type charge-generating grains are positively charged and the N-type charge-generating grains are negatively charged to effectively form aggregates.

The present inventors have confirmed through experiments the fact that even when the grains are mixed together in an organic solvent, the individual grains are not stably dispersed and the efficiency for forming aggregates strikingly decreases when there is used an alcohol, cyclohexane, toluene or dioxane.

In the wet method, the aggregates can be effectively formed by effecting the wet pulverization using a ball mill, a colloid mill, a disperse mill or a homo mixer.

In the dry method, the P-type charge-generating grains and the N-type charge-generating grains are mixed together and are pulverized together. Even by the mechano-chemical method, the grains are ground into primary grains which then aggregate together, so that aggregates grow. In the dry method, the pulverization is carried out using a ball mill and a vibration mill together.

The P-type charge-generating grains and the N-type charge-generating grains can be used in amounts of the above-mentioned ratio. In the case of the photosensitive material of the positively charged type, the photosensitive material should advantageously be comprised chiefly of the N-type charge-generating grains. By forming the aggregates by blending the P-type charge-generating grains in small amounts, improved balance is obtained in the spectral sensitivity and the sensitivity can be increased on the side of long wavelengths.

In the case of the photosensitive material of the negatively charged type, the photosensitive material should advantageously be comprised chiefly of the P-type charge-generating grains. By forming the aggregates by blending the N-type charge-generating grains in small amounts, improved balance is obtained in the spectral sensitivity and the sensitivity can be increased on the side of long wavelengths.

By using the P-type charge-generating grains and the N-type charge-generating grains at a nearly equal ratio, furthermore, there is obtained a photosensitive material of the type that can be charged into either polarity.

When the ratio of the amounts of the P-type charge-generating grains and of the N-type charge-generating grains is deviated to either side, the grains of the side of the larger amount may exist in the form of individual grains liberated from the aggregates. However, the presence of such free grains does not adversely affect the sensitivity.

The aggregates used in the present invention are made up of a plurality of the P-type (N-type) charge-generating grains that are aggregated together via the N-type (P-type) charge-generating grains, and should have a grain size of from 0.2 to 2 μm.

When the grain size exceeds 2 μm, the sensitivity and electrically charging performance of the photosensitive material tend to decrease. This is attributed to that the central grains in the aggregates are concealed and that the light-receiving areas decrease. It is further considered that the presence of giant grains permits the electric charge to leak in the photosensitive layer, which causes the electrically charging performance to decrease.

When the grain size of the aggregates is smaller than the above-mentioned range, on the other hand, balance in the spectral sensitivity decreases compared with that of when the grain size lies within the above-mentioned range, and the sensitivity decreases on the side of long wavelengths.

Photosensitive Material of the Single Layer Type

In the photosensitive material of the single layer type, aggregates of the P-type and N-type charge-generating grains and the charge-transporting agent are dispersed in a solution of a binder resin for forming the photosensitive layer, and this coating composition is provided on the electrically conducting substrate to obtain a single-layer photosensitive material.

The coating solution is prepared by a known method using, for example, a roll mill, a ball mill, an attritor, a paint shaker or an ultrasonic dispersing machine, and is then applied using a widely known coating means, followed by drying.

As the charge-transporting agent, there can be used any known electron-transporting agent or positive hole-transporting agent, such as the compounds exemplified below. These charge-transporting agents can be used in a single kind of in a combination of a plurality of kinds. For instance, the electron-transporting agent can be used in combination with a small amount of the positive hole-transporting agent or, conversely, the positive hole-transporting agent can be used in combination with a small amount of the electron-transporting agent.

Preferred examples of the electron-transporting agent include:

2,6-dimethyl-2',6'-di-t-butyldiphenoquinone,
2,2'-dimethyl-6,6'-di-t-butyldiphenoquinone,
2,6'-dimethyl-2',6-di-t-butyldiphenoquinone,
2,6,2',6'-tetramethyldiphenoquinone,
2,6,2',6'-tetra-t-butyldiphenoquinone,
2,6,2',6'-tetraphenyldiphenoquinone,
2,6,2',6'-tetracyclohexyldiphenoquinone,
chloroanil,
bromoanil,
tetracyanoethylene,
tetracyanoquinodimethane,
2,4,7-trinitro-9-fluorenone,
2,4,5,7-tetranitro-9-fluorenone,
2,4,7-trinitro-9-dicyanomethylene fluorenone,
2,4,5,7-tetranitroxanthone, and
2,4,8-trinitrothioxanthone.

Preferred examples of the positive hole-transporting agent include:

N-ethylcarbazole,
N-isopropylcarbazole,
N-methyl-N-phenylhydrazino-3-methylidyne-9-carbazole,
N,N-diphenylhydrazino-3-methylidyne-9-thylcarbozole,
N,N-diphenylhydrazino-3-methylidyne-10-ethylphenothiazine,
N,N-diphenylhydrazino-3-methylidyne-10-ethylphenoxazine,
p-diethylaminobenzaldehyde-N,N-diphenylhydrazone,
p-diethylaminobenzaldehyde-α-naphthyl-N-phenylhydrazone,
p-pyrrolydinobenzaldehyde-N,N-diphenylhydrazone,
1,3,3-trimetylindolenine-ω-aldehyde-N,N-diphenylhydrazone,
p-diethylbenzaldehyde-3-methylbenzthiazolinone-2-hydrazone,
2,5-bis(p-diethylaminophenyl)-1,3,4-oxadiazole,
1-phenyl-3-(p-diethylaminostyryl)-5-(p-diethylaminophenyl)pyrazoline,
1-[quinonyl(2)]-3-(p-diethylaminostyryl)-5-(p-diethylaminophenyl)pyrazoline,
1-[pyridyl(2)]-3-(p-diethylaminostyryl)-5-(p-diethylaminophenyl)pyrazoline,
1-[6-methoxypyridyl(2)]-3-(p-diethylaminostyryl)-5-(p-diethylaminophenyl)pyrazoline,
1-[pyridyl(3)]-3-(p-diethylaminostyryl)-5-(p-diethylaminophenyl)pyrazoline,
1-[lepidyl(3)]-3-(p-diethylaminostyryl)-5-(p-diethylaminophenyl)pyrazoline,
1-[pyridyl(2)]-3-(p-diethylaminostyryl)-4-methyl-5-(p-diethylaminophenyl)pyrazoline,
1-[pyridyl(2)]-3-(α-methyl-p-diethylaminostyryl)-3-(p-diethylaminophenyl)pyrazoline,
1-phenyl-3-(p-diethylaminostyryl)-4-methyl-5-(p-diethylaminophenyl)pyrazoline,
2-(p-diethylaminostyryl)-3-diethylaminobenzoxazole,
2-(p-diethylaminophenyl)-4-(p-dimethylaminophenyl)-5-(2-chlorophenyl)oxazole,
2-(p-diethylaminostyryl)-6-diethylaminobenzothiazole,
bis(4-diethylamino-2-methylphenyl)phenylmethane,
1,1-bis(4-N,N-diethylamino-2-methylphenyl)heptane,
1,1,2,2-tetrakis(4-N,N-dimethylamino-2-methylphenyl)ethane,
N,N'-diphenyl-N,N'-bis(methylphenyl)benzidine,
N,N'-diphenyl-N,N'-bis(ethylphenyl)benzidine,
N,N'-diphenyl-N,N'-bis(propylphenyl)benzidine,
N,N'-diphenyl-N,N'-bis(butylphenyl)benzidine,
N,N'-bis(isopropylphenyl)benzidine,
N,N'-diphenyl-N,N'-bis(secondary butylphenyl)benzidine,
N,N'-diphenyl-N,N'-bis(tertiary butylphenyl)benzidine,
N,N'-diphenyl-N,N'-bis(chlorophenyl)benzidine,
triphenylamine,
poly-N-vinylcarbazole,
polyvinylpyrene,
polyvinylanthracene,
polyvinylacridine,
poly-9-vinylphenylanthracene,
pyrene formaldehyde resin, and
ethylcarbazole formaldehyde resin.

A variety of resins can be used as a resin medium for dispersing the electron-transporting agent and the electron-generating agent. For example, there can be used a variety of polymers like olefin polymers such as styrene polymer, acrylic polymer, styrene-acrylic polymer, ethylene-vinyl acetate copolymer, polypropylene, and ionomer, as well as photocuring resins such as polyvinyl chloride, vinyl chloride-vinyl acetate copolymer, polyester, alkyd resin, polyamide, polyurethane, epoxy resin, polycarbonate, polyallylate, polysulfone, diallyl phthalate resin, silicone resin, ketone resin, polyvinyl butylal resin, polyether resin, phenol resin and epoxy acrylate resin.

These binder resins can be used in a single kind or being mixed in two or more-kinds. Preferred resins are styrene polymer, acrylic polymer, styrene-acrylic polymer, polyester, alkyd resin, polycarbonate and polyallylate.

A variety of organic solvents can be used for forming the coating solution. Examples thereof include alcohols such as methanol, ethanol, isopropanol and butanol, aliphatic hydrocarbons such as n-hexane, octane and cyclohexane, aromatic hydrocarbons such as benzene, toluene and xylene, halogenated hydrocarbons such as dichloromethane, dichloroethane, carbon tetrachloride and chlorobenzene, ethers such as dimethyl ether, diethyl ether, tetrahydrofurane, ethylene glycol dimethyl ether, and diethylene glycol dimethyl ether, ketones such as acetone, methyl ethyl ketone and cyclohexanone, esters such as ethyl acetate and methyl acetate, as well as dimethyl formamide and dimethyl sulfoxide, which can be used in a single kind or being mixed in two or more kinds together.

Though there is no particular limitation in the composition of the photosensitive layer, the charge-generating agent composed of the aforementioned grains should occupy from 75 to 1% by weight and, particularly, from 20 to 3% by weight of the whole amount on the basis of dry weight. The charge-transporting agent, on the other hand, should be contained in an amount of from 80 to 10% by weight and, particularly, from 80 to 30% by weight of the whole amount. When the amounts of the charge-generating agent and the charge-transporting agent are smaller than the above-mentioned ranges, sensitivity is not obtained to a sufficient degree and when their amounts are larger than the above-mentioned ranges, the charging amount tends to decrease and abrasion resistance of the photosensitive layer tends to decrease, too.

The coating solution should have a solid component concentration of generally from 5 to 50% by weight.

The composition for forming the photosensitive material of the present invention may be blended with a variety of widely known blending agents such as antioxidizing agent, radical scavenger, singlet quencher, UV-absorbing agent, softening agent, surface-reforming agent, defoaming agent, filler, viscosity-imparting agent, dispersion stabilizer, wax, acceptor, and donor.

A variety of materials having electrically conducting property can be used as an electrically conducting substrate on which the photosensitive layer is to be provided. Examples include metals such as aluminum, copper, tin, platinum, gold, silver, vanadium, molybdenum, chromium, cadmium, titanium, nickel, indium, stainless steel and brass, as well as a plastic material on which the above-mentioned metals are deposited or laminated, and a glass covered with aluminum iodide, tin oxide or indium oxide. In general, it is desired to use an aluminum blank tube and, particularly, a blank tube treated with alumite such that the film thickness thereof is from 1 to 50 μm.

The photosensitive layer of the single dispersion type should, generally, have a thickness of from 5 to 100 μm and, particularly, from 10 to 50 μm. When the thickness is smaller than the above range, the surface potential tends to decrease and when the thickness is larger than the above range, on the other hand, the sensitivity decreases and the residual potential increases.

Photosensitive Material of the Laminated Layer Type

Among the photosensitive materials of the laminated layer type of the present invention, the photosensitive material shown in FIG. 4 has the charge-generating layer provided on the electrically conducting substrate. The coating composition for forming the charge-generating layer is obtained by dispersing the charge-generating agent in the aforementioned resin solution, and should contain the charge-generating agent in an amount of from 99 to 1% by weight and, particularly, from 80 to 50% by weight reckoned as solid components, and should further have a thickness of from 0.01 to 10 μm and, particularly, from 0.1 to 5 μm.

Then, the charge-transporting layer is provided on the charge-generating layer. The charge-transporting layer is obtained by dispersing the above-mentioned charge-transporting agent in the above-mentioned resin solution, and should contain a derivative in an amount of from 80 to 10% by weight and, particularly, from 60 to 30% by weight per the total solid components of the two, and should further have a thickness of from 1 to 100 μm and, particularly, from 5 to 50 μm.

For the positively charging applications, the charge-transporting agent in the charge-generating agent should be chiefly comprised of an electron-transporting agent and for the negatively charging applications, the charge-transporting agent in the charge-generating agent should be chiefly comprised of a positive hole-transporting agent.

Among the photosensitive materials of the laminated layer type of the present invention, the photosensitive material shown in FIG. 8 has the charge-transporting layer provided on the electrically conducting substrate, and further has the charge-generating layer provided thereon. The compositions and thicknesses of the charge-transporting layer and of the charge-generating layer may be the same as those of the aforementioned case.

EXAMPLES

The invention will now be explained by way of the following Examples.

In Examples, measurements were taken as described below.

Initial Properties

By using an electrostatic copy testing apparatus (EPA-8100 manufactured by Kawaguchl Denki Co.), sheet-like photosensitive materials for electrophotography prepared in Examples and Comparative Examples were electrically charged by so adjusting the flow of electric current that the initial surface potential SP1 (V) was +700 V. Then, by using an interference filter, the lights having wavelengths of 500 nm and 700 nm were taken out from a xenon lamp that was the source of light for exposure, and were, respectively, projected for an exposure period of two seconds (10 μW) in order to measure their half-value exposure quantities.

That is, the time was measured until the initial surface potential +700 V became ½, and the half-value exposure quantity (μJ/cm$^2$) was found as sensitivity.

Moreover, the surface potential at a moment when three seconds have passed from the start of exposure was found as the initial residual potential RP1 (V), and the potential attenuation factor (4) was calculated in compliance with the following formula.

(Initial surface potential−initial residual potential)/initial surface potential×100=potential attenuation factor (%)

Properties after Repetitive Use

The sheet-like photosensitive materials for electrophotography prepared in Examples and Comparative Examples were subjected to the charging step in which the flow of current was adjusted as described above, to the exposure step (same as described above but without using interference filter), and to the discharging step (irradiated with white light of 1000 lux for one second) a hundred times repetitively using the above-mentioned electrostatic copy testing apparatus (EPA-8100 manufactured by Kawaguchi Denki Co.). Thereafter, the surface potential SP100 (V) and the residual potential RP(100 (V)) were measured in the same manner as described above, and differences from the initial surface potential and the initial residual potential were calculated by using the following formulas.

$$\Delta SP=(SP100)-(SP1)$$

$$RP=(RP100)-(RP1)$$

Example 1

A perylene pigment of the following formula (4) and an X-type metal-free phthalocyanine of the following formula (5) were pre-dispersed at a ratio of 10 parts by weight to one part by weight in 100 parts by weight of the THF for one hour using a ball mill, to which were then added 50 parts by weight of an N,N-diethylamino-p-benzaldehyde diphenylhydrazone (DEH; compound of the formula (8)) as a charge-transporting agent and 100 parts by weight of a polycarbonate (produced by Mitsubishi Gas Kagaku Co.) as a binder resin. The mixture was then homogeneously dispersed for one hour using the ball mill to prepare a coating solution which was then heat-treated at 120° C. for one hour, and was applied onto an aluminum substrate (sheet) such that the film thickness was 20 μm (grain size of aggregates: 0.2 to 2 μm).

The dispersion structure in the photosensitive layer was as shown in FIG. 1.

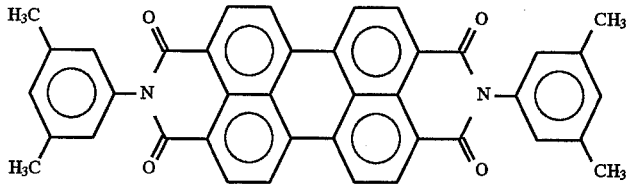

(4)

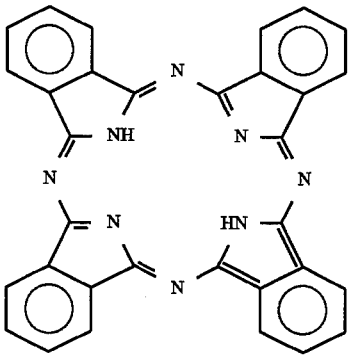

(5)

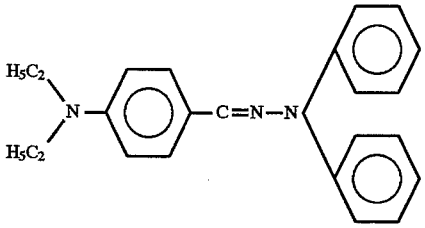

(6)

Example 2

Aggregates (grain size of aggregates: 0.2 to 2 μm) were formed in the same manner as in Example 1 but using an azo pigment (compound of the following formula (7)) instead of the perylene pigment, and a photosensitive material was formed in the same manner as in Example 1.

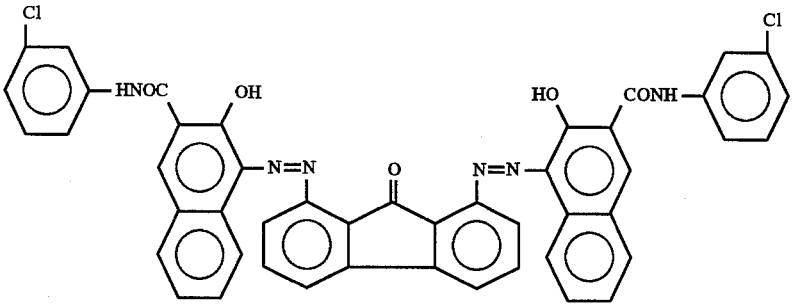

(7)

Example 3

Aggregates (grain size of aggregates: 0.2 to 2 μm) were formed in the same manner as in Example 1 but using an a polycyclic quinone pigment (compound of the following formula (8)) instead of the perylene pigment, and a photosensitive material was formed in the same manner as in Example 1.

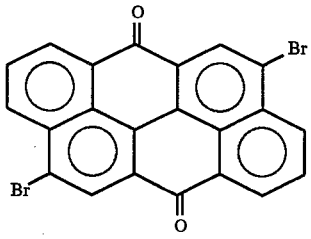

(8)

Example 4

Aggregates (grain size of aggregates: 0.2 to 2 μm) were formed in the same manner as in Example 1 but using an a naphthalocyanine (compound of the following formula (9)) instead of the X-type metal-free phthalocyanine, and a photosensitive material was formed in the same manner as in Example 1.

(9)

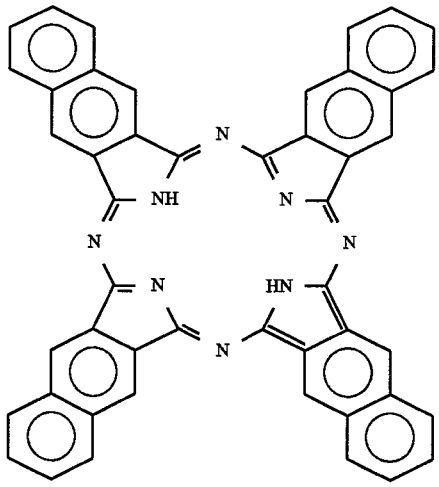

Example 5

Aggregates (grain size of aggregates: 0.2 to 2 μm) were formed in the same manner as in Example 1 but using the perylene pigment and the X-type metal-free phthalocyanine at a ratio of 10 parts by weight to 3 parts by weight, and a photosensitive material was formed in the same manner as in Example 1.

Example 6

Aggregates (grain size of aggregates: 0.2 to 2 μm) were formed in the same manner as in Example 1 but using the perylene pigment and the X-type metal-free phthalocyanine at a ratio of 10 parts by weight to 0.2 parts by weight, and a photosensitive material was formed in the same manner as in Example 1.

Example 7

Aggregates (grain size of aggregates: 0.2 to 2 μm) were formed in the same manner as in Example 1 but dispersing the perylene pigment and the X-type metal-free phthalocyanine in the THF for 100 hours using the ball mill, and a photosensitive material was formed in the same manner as in Example 1.

Comparative Example 1

A photosensitive material was formed in the same manner as in Example 1 but using the perylene pigment alone in an amount of 10 parts by weight.

Comparative Example 2

A photosensitive material was formed in the same manner as in Example 1 but using the X-type metal-free phthalocyanine alone in an amount of 1 part by weight.

Comparative Example 3

A photosensitive material was formed in the same manner as in Example 1 but using the X-type metal-free phthalocyanine alone in an amount of 10 parts by weight.

Comparative Example 4

A photosensitive material was formed in the same manner as in Example i but dispersing the perylene pigment and the X-type metal-free phthalocyanine together with the charge-transporting agent and the binder resin without pretreatment.

The dispersion structure of this photosensitive layer was as shown in FIG. 2, from which formation of aggregates was not recognized.

Comparative Example 5

A photosensitive material was formed in the same manner as in Example 1 but by dispersing the perylene pigment and the X-type metal-free phthalocyanine for 5 minutes using a ball mill as the pretreatment.

In this photosensitive material, aggregates of the metal-free phthalocyanine have not been completely formed in the photosensitive layer.

Comparative Example 6

A photosensitive material was formed in the same manner as in Example 1 but using toluene for pre-treating the perylene pigment and the X-type metal-free phthalocyanine.

No aggregates had been formed in this photosensitive layer probably because the polarity of the solvent was so weak that no aggregate was formed.

Comparative Example 7

A photosensitive material was formed in the same manner as in Example 1 but using benzene for pre-dispersing the perylene pigment and the X-type metal-free phthalocyanine.

No aggregates had been formed in this photosensitive layer probably because the polarity of the solvent was so weak that no aggregate was formed.

Comparative Example 8

A photosensitive material was formed in the same manner as in Comparative Example 4 but using the perylene pigment and the X-type metal-free phthalocyanine each in an amount of 10 parts by weight.

The results obtained were as tabulated below.

TABLE 1

Measuring method:
Photosensitive materials were electrically charged to +700 V and were then irradiated with monochromatic light of 10 μW for 2 seconds.
SP: surface potential before exposed
RP: surface potential after exposed

| | Half-value exposure quantity (μJ/cm²) | | Potential attenuation factor (%) | | Charging ability (μA) | Property (V) after repeated 100 times | |
|---|---|---|---|---|---|---|---|
| | 500 nm | 700 nm | 500 nm | 700 nm | SP = 700 V | SP change (ΔSP) | RP change (ΔRP) |
| Example 1 | 2.1 | 15.9 | 81 | 52 | 31 | −10 | +5 |
| Example 2 | 0.6 | 9.3 | 88 | 60 | 32 | −10 | +6 |
| Example 3 | 1.2 | 13.4 | 87 | 56 | 30 | −10 | +5 |
| Example 4 | 2.1 | 16.2 | 81 | 51 | 30 | −10 | +10 |
| Example 5 | 2.1 | 5.3 | 81 | 70 | 35 | −16 | +12 |
| Example 6 | 2.1 | 19.8 | 81 | 50 | 30 | −9 | +12 |
| Example 7 | 2.1 | 15.8 | 81 | 52 | 31 | −12 | +8 |
| Comp. Example 1 | 2.1 | was not halved | 81 | 1 | 30 | −11 | +15 |
| Comp. Example 2 | was not halved | " | 1 | 15 | 20 | — | — |
| Comp. Example 3 | " | 5.0 | 1 | 73 | 28 | — | +20 |
| Comp. Example 4 | 2.1 | was not halved | 80 | 15 | 32 | −25 | +20 |
| Comp. Example 5 | 2.1 | " | 81 | 16 | 31 | −10 | +8 |
| Comp. Example 6 | 2.1 | " | 81 | 15 | 30 | −10 | +9 |
| Comp. Example 7 | 2.1 | " | 81 | 15 | 30 | −10 | +8 |
| Comp. Example 8 | 3.2 | 8.9 | 135 | 64 | 43 | −120 | +56 |

Example 8

An X-type metal-free phthalocyanine and $TiO_2$ were dispersed at a ratio of 10 parts by weight to one part by weight in 100 parts by weight of the THF for one hour using a ball mill, to which were then added 50 parts by weight of the DEH as a charge-transporting agent and 100 parts by weight of a polycarbonate (produced by Mitsubishi Gas Kagaku Co.) as a binder resin. The mixture was then homogeneously dispersed for one hour using the ball mill to prepare a coating solution which was then heat-treated at 120° C. for one hour, and was applied onto an aluminum substrate (sheet) such that the film thickness was 20 μm.

Example 9

A photosensitive material was formed in the same manner as in Example 1 but using $TiO_2$ in an amount of 10 parts by weight.

Example 10

A photosensitive material was formed in the same manner as in Example 1 but using $TiO_2$ in an amount of 40 parts by weight.

Example 11

A photosensitive material was formed in the same manner as in Example 1 but using $SnO_2$ instead of $TiO_2$.

Example 12

A photosensitive material was formed in the same manner as in Example 1 but using antimony-doped tin oxide ($SnSb_xO_2$) instead of $TiO_2$.

Example 13

A photosensitive material was formed in the same manner as in Example 1 but using indium-doped tin oxide ($SnIn_xO_2$) instead of $TiO_2$.

Comparative Example 9

A photosensitive material was formed in the same manner as in Example 8 without using X-type metal-free phthalocyanine but using $TiO_2$ in an amount of 50 parts by weight.

Comparative Example 10

A photosensitive material was formed in the same manner as in Example 8 without using X-type metal-free phthalocyanine but using $TiO_2$ in an amount of 0.1 parts by weight.

Photosensitive materials obtained in Examples 8 to 13 and in Comparative Examples 3, 9 and 10 were evaluated for their properties and abrasion resistance in the same manner as in Example 1. The results were as shown in Table 2. The abrasion resistance was evaluated by measuring a difference between the initial thickness of the photosensitive layer and the thickness of the photosensitive layer after the copying operation was repeated 1000 times by using a printer (LDC-630, produced by Mira Kogyo Co.).

TABLE 2

| | Half-value exposure quantity (μJ/cm²) | Potential attenuation factor (%) | Charging ability (μA) | Property (V) after repeated 100 times | | Worn-out amount after 10,000 times (μm) |
|---|---|---|---|---|---|---|
| | | | | SP | RP | |
| Example 8 | 3.8 | 85 | 30 | −10 | +12 | 0.5 |
| Example 9 | 3.1 | 89 | 33 | −10 | +10 | 0.3 |
| Example 10 | 2.8 | 92 | 38 | −10 | +10 | 0.1 |
| Example 11 | 3.9 | 85 | 30 | −10 | +10 | 0.5 |
| Example 12 | 3.6 | 84 | 32 | −10 | +10 | 0.5 |

TABLE 2-continued

| | Half-value exposure quantity | Potential attenuation | Charging ability | Property (V) after repeated 100 times | | Worn-out amount after 10,000 times |
|---|---|---|---|---|---|---|
| | ($\mu J/cm^2$) | factor (%) | ($\mu A$) | SP | RP | ($\mu m$) |
| Example 13 | 3.6 | 83 | 32 | −10 | +10 | 0.5 |
| Comparative Example 3 | 5.1 | 73 | 28 | −10 | +20 | 1.0 |
| Comparative Example 9 | — | — | not charged | | | |
| Comparative Example 10 | 5.0 | 73 | 29 | −10 | +22 | 1.0 |

It will be understood from the results of Table 2 that according to the present invention, the half-value exposure quantity is small, the potential attenuation factor is high, the residual potential difference is small even after being treated 100 times, and the amount ($\mu m$) worn out is small even after being repeated 10,000 times. Therefore, the photosensitive material of the present invention exhibits very high sensitivity and excellent surface abrasion resistance.

It will be further understood that the N-type inorganic semiconductor or photoconductor ($TiO_2$ in Table 2) that is added in an increased amount makes it possible to improve not only the charge generation efficiency but also the charge-transporting efficiency and sensitivity.

I claim:

1. A photosensitive material for electrophotography having an electrically conducting substrate and a photosensitive layer containing a charge-generating agent and a charge-transporting agent, wherein said charge-generating agent comprises (A) grains of P-type charge-generating pigment selected from the group consisting of X-type metal-free phthalocyanine, oxotitanyl phthalocyanine and metal-free naphthalocyanine and (B) grains of N-type charge-generating pigment; wherein the grains of P-type charge-generating pigment and the grains of N-type charge-generating pigment are present, at a ratio by weight, in the range of from 10:0.1 to 0.1:10, and wherein said grains of P-type and said grains of N-type are pretreated together by a wet method or a dry method and dispersed in a binder whereby the charge-generating agent forms aggregates comprised of a plurality of grains of said P-type charge-generating pigment aggregated via a plurality of grains of said N-type charge-generating pigment.

2. The photosensitive material of claim 1 wherein the weight ratio of said P-type grains to said N-type grains is in the range of from 10:0.5 to 0.5:10.

3. A photosensitive material for electrophotography having an electrically conducting substrate and a photosensitive layer containing a charge-generating agent and a charge-transporting agent, wherein said charge-generating agent comprises (A) grains of P-type charge-generating pigment selected from the group consisting of X-type metal-free phthalocyanine, oxotitanyl phthalocyanine and metal-free naphthalocyanine and (B) grains of N-type charge generating agent selected from the group consisting of N-type inorganic semiconductor and N-type inorganic photoconductor wherein the grains of P-type charge-generating pigment and the grains of N-type charge-generating agent are present, at a ratio by weight, in the range from 10:1 to 1:40, and wherein said grains of P-type and said grains of N-type are pretreated together by a wet method or a dry method and dispersed in a binder whereby the charge-generating agent forms aggregates comprised of a plurality of grains of said P-type charge-generating pigment aggregated via a plurality of grains of said N-type charge-generating agent.

4. The photosensitive material of claim 3 wherein the weight ratio of the P-type grains to the N-type grains is in the range of from 2:1 to 6:40.

* * * * *